US005503097A

United States Patent [19]

Main

[11] Patent Number: 5,503,097

[45] Date of Patent: Apr. 2, 1996

[54] HIGH PERFORMANCE CENTERBOARD SYSTEM

[76] Inventor: John R. Main, 9206 Grundy La., Chatsworth, Calif. 91311

[21] Appl. No.: 292,976

[22] Filed: Aug. 23, 1994

[51] Int. Cl.[6] ..... B63B 3/38

[52] U.S. Cl. ..... 114/132; 114/127

[58] Field of Search ..... 114/130, 132, 114/138, 140, 141, 39.2, 39.1; 441/74, 79

[56] References Cited

U.S. PATENT DOCUMENTS 5,036,783 8/1991 Ilievsky et al. ..... 114/138

FOREIGN PATENT DOCUMENTS 3038938 5/1982 Germany ..... 114/132

3438116 4/1986 Germany ..... 114/132

*Primary Examiner*—Edwin L. Swinehart

*Attorney, Agent, or Firm*—Gerald L. Price

[57] ABSTRACT

A movable centerboard for water craft capable of multiple settings having an upper position within the hull, a lower position at full depth below the hull and multiple settings therebetween such that the system is adapted to receive and operate the centerboard from above. The centerboard and centerboard well are adapted to operate in concert whereby, multiple board positions may be utilized. Introduced from above, the centerboard slides down to an upper position within the hull, from here it can either pivot up completely into the well or it can continue to slide diagonally to its maximum depth whereupon it can pivot to the vertical lower position. The selected positions of the centerboard are held in place by a control pressure wedging device from above, whereupon being struck from below will release allowing the board to pivot and transverse up into the well.

21 Claims, 2 Drawing Sheets

HIGH PERFORMANCE CENTERBOARD SYSTEM

BACKGROUND OF THE INVENTION

The keel is the back bone of any water craft and lies fore and aft along the center line of the bottom. In sailing craft as opposed to power boats, keels are designed to increase lateral resistance. This is the hulls ability to resist being driven sideways by the wind. The resistance increases by designing keels short and deep (i.e. high- aspect- ratio) rather than long and shallow. The centerboard is a form of drop keel that pivots into the water from a well situated over the keel. When the board operates in a similar style to a knife in a sheath it is called a daggerboard. Each system has advantages and disadvantages. Specifically, centerboards pivot and will kick-up when the board strikes an object. This feature is very convenient and has saved many centerboard craft from annoying and sometimes serious damage. Ideally, the centerboard can be pivoted up and out of the way within the hull allowing for beaching and transporting without removal. A disadvantage of centerboards is the turbulence caused by a large open well slot in the hull bottom which is needed to accommodate the pivoting centerboard. Some centerboards are designed to completely fill the well slot at all angles of pivot which eliminates the need for gaskets. The pivoting gasketless design is very convenient and trouble free, however the resulting board shape is less efficient. Conversely, some centerboard designs have an efficient board shape but the remaining open well slot must be sealed to reduce turbulence. Many high-performance centerboard craft go to great lengths to seal open well slots in order to reduce turbulence. Gaskets are often used to seal well slots but are a continual maintenance problem and usually prohibit be, aching. Modem hydrodynamic theory says that a high-aspect-ratio, (i.e. large depth to width ratio) board is more efficient for windward points of sail. Daggerboards, which move up and down vertically, can be very efficient because they can have a high-aspect ratio board without a large well slot and no gaskets. The daggerboard can also be used in a wide range of positions from fully down to nothing showing below the hull. This makes for a very efficient gasketless system. The main disadvantage of a daggerboard is its inability to automatically kick up if struck by an object. The potential for serious damage is always present. Another very annoying inconvenience is the protruding daggerboard above deck in all but the full down position. Also, while transporting, the daggerboard must be removed from the hull resulting in handling and storage problems.

The present invention combines all the advantages of both systems, resulting in the ease, safety and convenience of the centerboard and the performance of the high-aspect-ratio, gasketless daggerboard which incorporates the following objects and advantages:

(a) to provide a high-performance centerboard system which combines the performance potential of a traditional daggerboard system and the convenience and safety of a traditional centerboard system;

(b) to provide a high performance centerboard system with a minimum of moving parts;

(c) to provide a centerboard system that is easy to use in a wide range of sailing conditions;

(d) to provide a centerboard system that is capable of being used on high performance as well as pleasure craft;

(e) to provide a centerboard system that is capable of being made using light weight and high-strength materials;

(f) to provide a centerboard system that minimizes the well-slot size;

(g) to provide a centerboard system that requires no gaskets;

(h) to provide a centerboard system capable of being used on all sizes of craft;

(i) to provide a centerboard system which can be easily operated by hand, however, if size requires, be operable with some mechanical advantage device.

(j) to provide a centerboard system that is easy to manufacture;

Further objects and advantages are to provide a high performance centerboard system which can eliminate or reduce the disadvantages of traditional daggerboard/centerboard systems as well as those reviewed as prior art. One of the aims of this invention is to reduce disadvantages such as protruding boards into inconvenient places, excessive weight, large well slot sizes, gaskets, too many parts, impractical for high performance water craft, not user-friendly, not beachable, not easily removable and more. Still further objects and advantages of my invention will become apparent from a consideration of the drawings and ensuing description.

BACKGROUND DESCRIPTION OF PRIOR ART

U.S. Pat. No. 3,572,279 to Smoot (1971) describes a standard daggerboard with a tapered upper portion to allow some limited movement. This design is limited in its usefulness because the daggerboard can only pivot in the full down position and if grounded would become wedged in the well.

Pivoting centerboard systems are described in U.S. Pat. No. 5,182,367 to Namur (1993), U.S. Pat. No. 3,756,182 to Hackett (1973) and U.S. Pat. No. 4,563,971 to Carver (1986). In all cases the traditional centerboard problems of large well slots and cumbersome operation are present. Centerboards that roll on linear and curvilinear tracks are described in U.S. Pat. No. 3,547,065 to Elie (1970) and U.S. Pat. No. 5,036,783 to Ilievsky (1991). These designs are not suitable for high performance crafts requiring light weight boards that are easily operated from above. Also, the oversized wells create large water traps resulting in unneeded weight and turbulence.

SUMMARY OF THE INVENTION

It is the general aim of the present invention to provide a new and improved centerboard apparatus capable of a wide range of board settings yet remaining simple and safe to operate, relatively maintenance free, and which will consistently yield when struck from below, irrespective of the settings within its range of adjustment. To accomplish this aim, a novel combination of transverse and pivotal motion is employed. It has been determined by experience that a pivoting only centerboard is easy to use, is conveniently hidden within the hull, and most importantly, is safe because when struck from below the board will pivot up into the well. The disadvantages of the centerboard can be the less efficient board shapes and/or the resulting large well slots needed to accommodate the pivoting board and the problems associated with sealing these large slots. It has also been determined by experience that the non-pivoting daggerboard can be more efficient than the centerboard in reducing lateral movement while sailing. The daggerboards non-pivoting, up and down, range of motion allow for a deep and narrow board design (i.e. high-aspect-ratio), and a corresponding small well slot. However, the efficient performance of the high-aspect-ratio, gasketless and non-pivoting daggerboard is at the expense of giving up the safety and convenience of the pivoting centerboard.

In order to combine the advantages of both the aforestated systems, the preferred form of the apparatus embodying the present invention is provided so as to allow a high aspect ratio board to pivot or transverse irrespective of the board setting while still allowing for a small well slot. When struck from below the board automatically pivots and slides thereby reducing board and hull damage. The board is operable from above by a wedgeable handle which holds the board in place under normal sailing conditions yet will release when excessively loaded.

BRIEF DESCRIPTIONS OF THE DRAWINGS

FIG. 1 shows the side view of the hull containing the centerboard well.

FIGS. 1*a–d* show how the centerboard moves within the well.

DESCRIPTION OF THE PREFERRED EMBODIMENT

Figure 1:
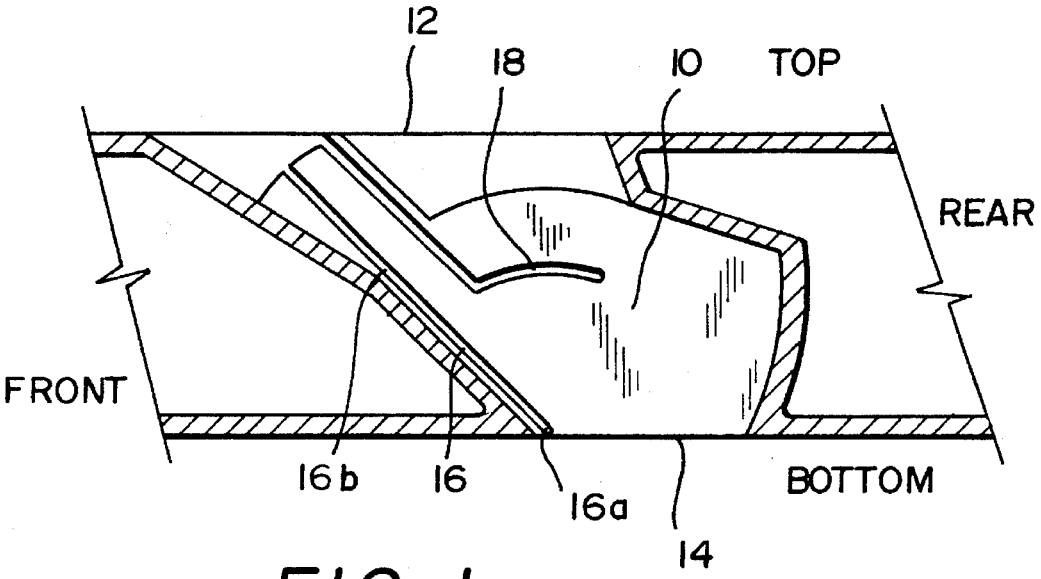

While the present invention is susceptible of various modifications and alternative constructions, illustrative embodiments are shown in the drawings and will herein be described in detail. It should be understood, however, that it is not intended to limit the invention to the particular forms disclosed, but, on the contrary, the intention is to cover all modifications, equivalents, and alternative constructions falling within the spirit and scope of the invention as expressed in the appended claims.

Figure 3:
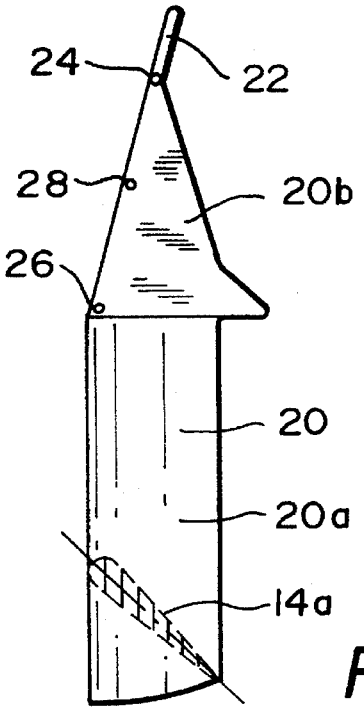
FIG. 3 shows the side view of the centerboard.

Referring now to FIGS. 1 and 3, an exemplary centerboard apparatus generally indicated at 20, is shown in conjunction with the centerboard well generally indicated at 10, is illustrated including an upper well opening 12 for receiving and operating the board and a lower well slot 14 from which the board penetrates below the hull. A pivoting handle 22 is secured to the upper board head 20*b* by means of a pivot pin 24, and facilitates the operation of the board as well as acting as a board holding device when wedged into the upper well opening 12.

Figure 2:
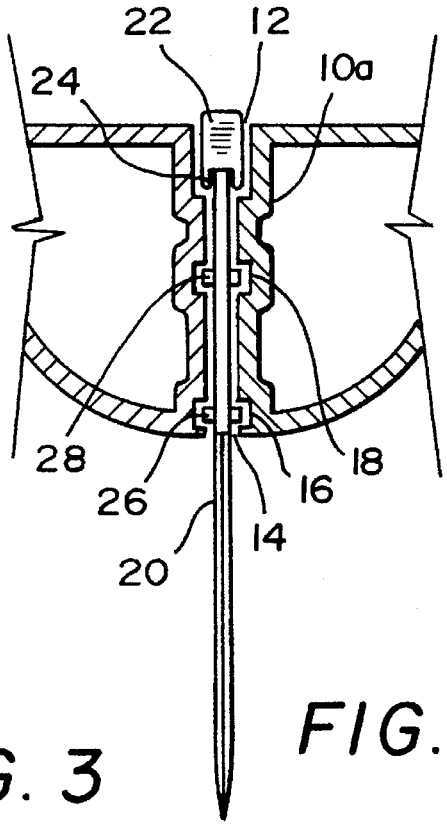
FIG. 2 shows the end view of the centerboard well.

Turning next to FIG. 2, the end view of the centerboard well 10 is depicted and as shown here includes an upper 18 and a lower 16 guide channel formed into the well side walls 10*a*. The centerboard pivot pin 26 travels in the lower guide channel 16 and guides the board as it transverses its range of motion, as depicted in FIGS. 1*a–d*, from the deck opening 12 down to a stop at the lower pivot point 16*a*. Integrated into the lower guide channel are two pivot points, an upper 16*b* and a lower 16*a*. The board can only pivot when pivot pin 26 is located at either of these two points and in all other positions the board can only slide parallel to the lower guide channel.

Figure 1A:
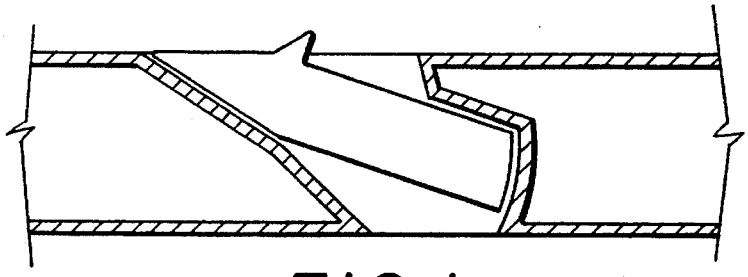

In carrying out one of the important aspects of the present invention, provision is made for allowing the board to pivot back from the vertical position (FIG. 1*d*) when struck by an object. The striking object will either be deflected by the angled board (FIG. 1*c*) or the board will slide up into the well to the upper pivot point (FIG. 1*b*) whereupon it can once again pivot completely into the well (FIG. 1*a*). This is accomplished by providing a pair of guide channels in which pivot pin 26 and guide pin 28 travel and are situated to guide the board through its full range of motion while keeping the board from over rotating and causing damage. It will be observed that the board has a wide range of settings and accordingly all settings are in a safe kick-up position.

To hold the various board settings the pivoting handle 22 is wedged into the upper well opening 12. The friction capacity of the handle has been determined by experience to hold pre-determined sailing loads, however, will release when these loads are exceeded.

Figure 1B:
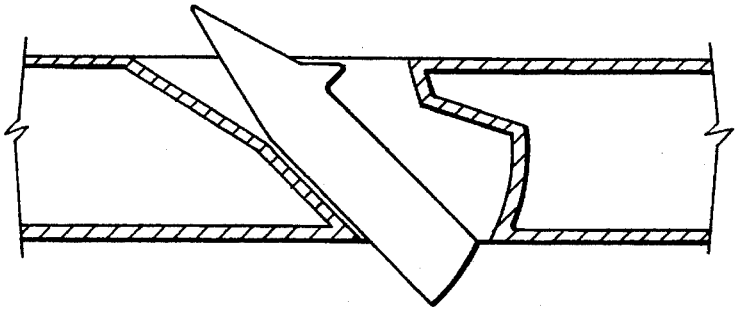
Figure 1C:
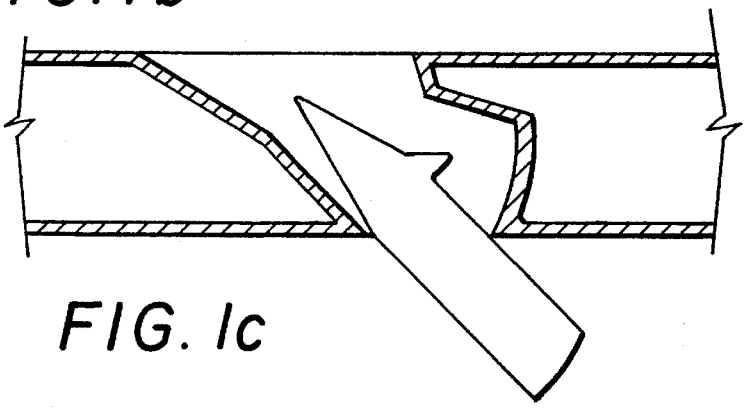
Figure 1D:
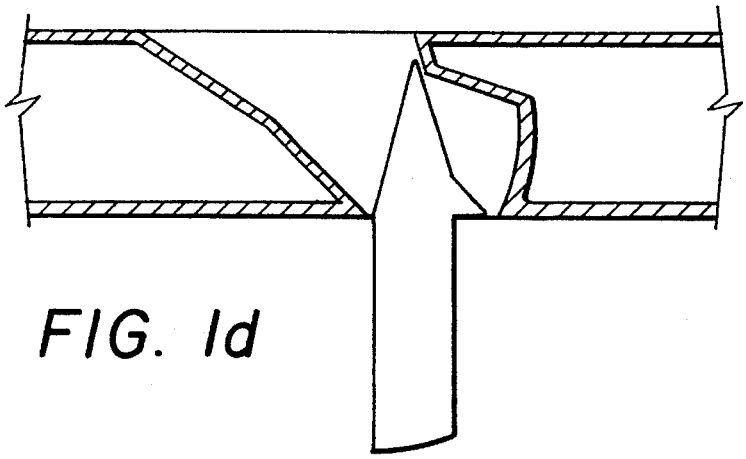

In accordance with the general aim of the present invention, provision is made to insure that for any desired board setting within the capacity range of an apparatus embodying the invention that these settings are easily operable from above and in all settings none or only a small portion of the board will protrude above the deck. Also, for beaching and transporting, the board can be completely secured within the hull as shown in FIG. 1*a*, for sailing conditions requiring no lateral resistance the board should be positioned as depicted in FIG. 1*b*, for conditions requiring some lateral resistance the board should utilize the various sliding depth settings that range between FIG. 1*b* and FIG. 1*c*, and for conditions requiring maximum resistance the board should be used as depicted in FIG. 1*d*.

It will be readily apparent that the diagonal cross-sectional shape 14*a* of the board's foil 20*a* will closely correspond to the shape of the well slot 14 and will therefore seal the well slot. Also, when the board is in the full down position (FIG. 1*d*) the lower portion of the board's head 20*b* will protrude across and seal the well slot. It is additionally pointed out that while the embodiment illustrated utilizes only one method to seal the well slot, it would be deemed within the province of the invention to employ alternate arrangements such as, for example, a movable sealing device attached to the board, the use of gaskets or just leaving the well slot unsealed.

In conclusion, while the apparatus heretofore described is a centerboard apparatus for watercraft, it will be readily apparent that the scope of the present invention would certainly not preclude alternative uses, for example, horizontal hydro-foils, wings, steps, tables, etc. Variations of the foregoing invention may occur to those skilled in the art and the scope of the invention should be limited only by the scope of the appended claims.

I claim:

1. A centerboard system for a watercraft having a hull, comprising:

a well disposed generally vertically in the hull of the watercraft, said well comprising a pair of spaced parallel sidewalls, an opening passing through a bottom of the hull, and an opening passing through a top of the hull;

a centerboard slideably received between said sidewalls and passing through said openings in the hull, said centerboard assuming both vertical and angular positions relative to the top of the hull and passing through said opening in the bottom of the hull into the water so as to be operative as an extended centerboard;

guide means in said well for guiding said centerboard as it is moved within said well in a predetermined path, said path having one position wherein said centerboard has a lower portion extended into the water so as to be operative as an extended centerboard, said path having at least one other position wherein said lower portion of the centerboard is partially retracted into said well;

said centerboard substantially closing said opening passing through the bottom of the hull when said centerboard is in an extended or partially retracted position; and maintaining means for selectively maintaining said centerboard in any of said positions.

2. In the centerboard system of claim 1, wherein said guide means comprises at least a first groove in the sidewall of said well, said system further comprising pin means on a side of said centerboard for slideably engaging said first groove.

3. In the centerboard system of claim 2, wherein said first groove is angularly disposed relative to the top of the hull, whereby at least a portion of the movement of said centerboard through said well is in an angular direction.

4. In the centerboard system of claim 2, wherein said guide means further comprises a second groove in the sidewall of said well, said second groove having an upper portion angularly disposed and generally parallel to said first groove and a lower portion defining a generally arcuate path, said system further comprising additional pin means positioned on said centerboard for slideably engaging said second groove, whereby, when said centerboard is slideably lowered through said well, it first moves in an angular path and then rotates into a generally vertical position.

5. In the centerboard system of claim 4, wherein the bottom of said first groove defines a stop for said pin means which corresponds to said additional pin means entering said lower portion of said second groove, whereby said pin means serves as a pivot point as said additional pin means traverses said generally arcuate path.

6. In the centerboard system of claim 5, wherein in a lowermost position the centerboard is in a generally vertical position having its lower portion fully extended through said lower opening so as to define a fully operative centerboard, and in an uppermost position the centerboard is substantially within said well in a generally angular position.

7. In the centerboard system of claim 1, wherein said well further comprises a pair of edge walls angularly disposed relative to said opening passing through the bottom of the hull for guiding the edge surfaces of said centerboard during movement thereof.

8. In the centerboard system of claim 7, wherein said guide means comprises at least a first groove in the sidewall of said well, said system further comprising pin means on a side of said centerboard for slideably engaging said first groove.

9. In the centerboard system of claim 8, wherein said first groove is angularly disposed relative to the top of the hull whereby, during movement of the centerboard corresponding to said first groove, the centerboard substantially closes said opening passing through the bottom of the hull.

10. In the centerboard system of claim 9, wherein said guide means further comprises a second groove in the sidewall of said well, said second groove having an upper portion angularly disposed and generally parallel to said first groove and a lower portion defining a generally arcuate path, said system further comprising additional pin means positioned on said centerboard for slideably engaging said second groove, whereby, when said centerboard is slideably lowered through said well, it first moves in an angular path and then rotates into a generally vertical position.

11. In the centerboard system of claim 10, wherein the bottom of said first groove defines a stop for said pin means which corresponds to said additional pin means entering said lower portion of said second groove, whereby said pin means serves as a pivot point as said additional pin means traverses said generally arcuate path.

12. In the centerboard system of claim 11, wherein in a lowermost position the centerboard is in a generally vertical position having its lower portion fully extended through said lower opening so as to define a fully operative centerboard, and in an uppermost position the centerboard is substantially within said well in a generally angular position.

13. In the centerboard system of claim 12, wherein said centerboard further comprises protrusion means for substantially closing said opening passing through the bottom of the hull when said centerboard is in the lowermost position.

14. In the centerboard system of claim 13, wherein said maintaining means can maintains said centerboard at any position between fully extended and fully withdrawn.

15. In the centerboard system of claim 14, wherein said maintaining means releases said centerboard in the event that any portion of said centerboard extending through said opening in said bottom of the hull meets solid resistance, thereby permitting said any portion of said centerboard to retract into said well.

16. In the system of claim 1, wherein said maintaining means comprises a pivoting handle disposed on a portion of said centerboard nearest the opening passing through the top of the hull, said pivoting handle having a friction capacity for holding said centerboard in position when said pivoting handle is wedged into the opening passing through the top of the hull.

17. A centerboard system for a watercraft having a hull, comprising:

a well disposed generally vertically in the hull of the watercraft, said well comprising a pair of spaced parallel sidewalls, an opening passing through a bottom of the hull, and an opening passing through the top of the hull;

a centerboard slideably received between said sidewalls and passing through said openings in the hull, said centerboard assuming both vertical and angular positions relative to the top of the hull and passing said opening in the bottom of the hull into the water so as to be operative as a fully extended centerboard; and guide means in said well for guiding said centerboard as it is moved within said well in a predetermined path having one position wherein said centerboard has lower portion fully extended into the water so as to be operative as a fully extended centerboard, said path having at least one other position wherein said lower portion of the centerboard is partially retracted into said well; and wherein said centerboard further comprises protrusion means for substantially closing said opening passing through the bottom of the hull when said centerboard is in a lowermost position.

18. In the centerboard of claim 17, further comprising maintaining means for maintaining said centerboard at any position between fully extended and fully withdrawn.

19. In the centerboard system of claim 18, wherein said maintaining means releases said centerboard in the event that any portion of said centerboard extending through said opening in said bottom of the hull meets solid resistance, thereby permitting said any portion of said centerboard to retract into said well.

20. In the system of claim 18, wherein said maintaining means comprises a pivoting handle disposed on a portion of said centerboard nearest the opening passing through the top of the hull, said pivoting handle having a friction capacity for holding said centerboard in position when said pivoting handle is wedged into the opening passing through the top of the hull.

21. A centerboard system for a watercraft having a hull, comprising:

a well disposed generally vertically in the hull of the watercraft, said well comprising a pair of spaced parallel sidewalls, an opening passing through a bottom of the hull, and an opening passing through a top of the hull;

a centerboard slideably received between said sidewalls and passing through said openings in the hull, said centerboard assuming both vertical and angular positions relative to the top of the hull and passing through said opening in the bottom of the hull into the water so as to be operative as an extended centerboard;

guide means in said well for guiding said centerboard as it is moved within said well in a predetermined path, said path having one position wherein said centerboard has a lower portion extended into the water so as to be operative as an extended centerboard, said path having at least one other position wherein said lower portion of the centerboard is partially retracted into said well;

said guide means initially enabling advancement of said centerboard along a non-vertical linear generally downward path toward an extended position and then enabling rotation of said centerboard into a vertical position maintaining means for selectively maintaining said centerboard in any of said positions.

* * * * *